US005722119A

United States Patent [19]

Wang

[11] Patent Number: 5,722,119

[45] Date of Patent: Mar. 3, 1998

[54] PULLING KNOB FOR FURNITURE

[76] Inventor: Sen Huang Wang, P.O. Box 63-99, Taichung, Taiwan

[21] Appl. No.: 760,194

[22] Filed: Dec. 4, 1996

[51] Int. Cl.[6] ..... E05B 1/00

[52] U.S. Cl. ..... 16/121

[58] Field of Search ..... 16/121, 118, DIG. 40, 16/DIG. 41; 403/297, 362, 368; 74/553; 292/347, 350

[56] References Cited

U.S. PATENT DOCUMENTS

| | | | |
|---|---|---|---|
| 1,798,409 | 3/1931 | Ferris | 16/121 |
| 1,958,497 | 5/1934 | Rivers | 16/121 |
| 2,209,644 | 7/1940 | Colby | 16/121 |
| 2,796,627 | 6/1957 | Heyer | 16/121 |
| 3,174,178 | 3/1965 | Branche et al. | 16/121 |
| 4,972,545 | 11/1990 | Ozagir et al. | 16/121 |
| 5,255,413 | 10/1993 | Sabo | 16/121 |

*Primary Examiner*—Chuck Mah

[57] ABSTRACT

A pulling knob for furniture includes a member having a hole formed in the center portion for engaging with a bolt and having a non-circular opening formed in the upper portion. The bolt includes a head formed on top and includes an outer thread formed in the lower portion for engaging with an inner thread of a hand grip. The bolt includes one or more ribs formed in the upper portion for engaging with the non-circular opening of the member and for preventing the bolt from rotating relative to the member.

1 Claim, 1 Drawing Sheet

PULLING KNOB FOR FURNITURE

BACKGROUND OF THE INVENTION

1. Field of the Invention

The present invention relates to a knob, and more particularly to a pulling knob for furniture.

2. Description of the Prior Art

Typical pulling knobs are secured to the door panels of the furniture for operating the door panels. For luxury furniture, the pulling knobs are typically made of ceramic material and include a head and a hand grip that are required to be secured together by a rivet member. However, while securing the rivet, the ceramic head will be easily damaged.

The present invention has arisen to mitigate and/or obviate the afore-described disadvantages of the conventional pulling knobs for furniture.

SUMMARY OF THE INVENTION

The primary objective of the present invention is to provide a pulling knob for furniture in which the pulling knob includes a configuration that may be easily manufactured.

The other objective of the present invention is to provide a pulling knob for furniture in which the pulling knob includes a body that may be prevented from being rotated relative to the hand grip.

In accordance with one aspect of the invention, there is provided a pulling knob for furniture comprising a body including a center portion having a hole formed therein, the center portion of the body including an upper portion having a non-circular opening formed therein, a bolt engaged through the hole of the body, the bolt including a head formed on top and including a lower portion having an outer thread formed thereon, the bolt including an upper portion having at least one rib formed thereon for engaging with the non-circular opening of the body and for preventing the bolt from rotating relative to the body, and a hand grip including an inner thread for engaging with the outer thread of the bolt for securing the bolt to the body. The rib of the bolt may prevent the bolt from rotating relative to the body, and the bolt may be easily and solidly secured to the body by the hand grip such that the elements may be easily assembled together without additional tools. In addition, the bolt is not required to be hammered such that the body will not be damaged.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
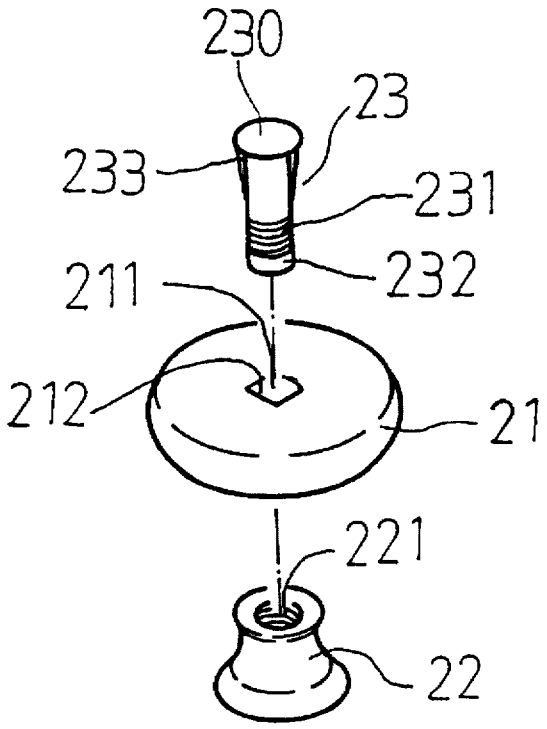
FIG. 1 is an exploded view of a pulling knob in accordance with the present invention.

Referring to the drawings, a pulling knob in accordance with the present invention comprises a body 21 made of ceramic material and including a hole 211 formed in the center portion and including a square or non-circular opening 212 formed in the upper center portion of the body 21. A bolt 23 may be engaged in the hole 211 of the body 21 and includes a head 230 formed on top and includes an outer thread 231 formed in the middle and lower portion for engaging with an inner thread 221 of a hand grip 22. The bolt 23 includes a bottom end 232 of reduced diameter for facilitating the engagement of the outer thread 231 with the inner thread 221 of the hand grip 22. The bolt 23 includes at least one rib 233 formed on the upper portion for engaging with the non-circular opening 212 of the body 21 and for preventing the bolt 23 from rotating relative to the body 21.

Figure 2:
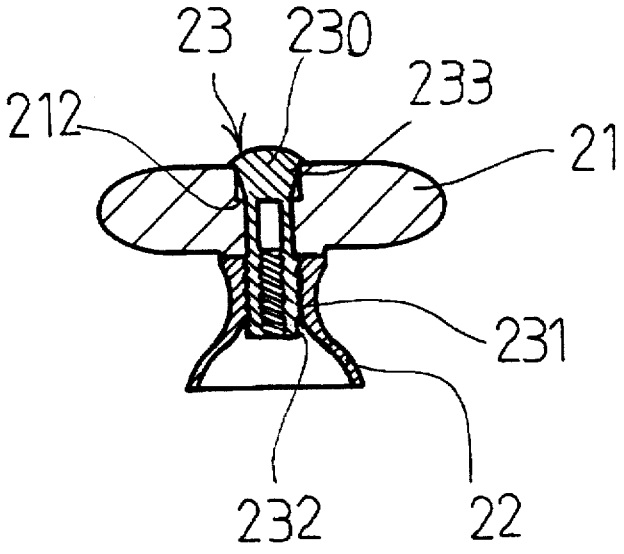
FIG. 2 is a cross sectional view of the pulling knob.

It is to be noted that the rib 233 of the bolt 23 may prevent the bolt 23 from rotating relative to the body 21 and the bolt 23 may be easily and solidly secured to the body 21 by the hand grip 22 such that the elements may be easily assembled together without additional tools. In addition, the bolt 23 is not required to be hammered such that the body 21 will not be damaged. The bolt 23 includes an inner thread (FIG. 2) for engaging with a fastener and for allowing the fastener to secure the knob to the furniture.

Accordingly, the pulling knob in accordance with the present invention includes a configuration that may be easily manufactured. In addition, the body may be prevented from rotating relative to the hand grip such that the elements may be easily assembled together.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A pulling knob for furniture comprising:

a knob body including a center portion having a hole formed therein, said hole including an upper portion having a non-circular opening formed therein, a bolt engaged through said hole of said knob body, said bolt including a head formed on top and including a lower portion having an outer thread portion and an inner thread portion formed thereon, said bolt including an upper portion having at least one rib formed thereon for engaging with said non-circular opening of said knob body and for preventing said bolt from rotating relative to said knob body, and a hand grip including an inner thread for engaging with said outer thread of said bolt for securing said bolt to said knob body.

* * * * *